US005768923A

United States Patent [19]

Hill

[11] Patent Number: 5,768,923

[45] Date of Patent: Jun. 23, 1998

[54] PROTECTIVE PLATE FOR AN AUTOMOBILE LOCKING MECHANISM

[76] Inventor: Mark Langdon Hill, P.O. Box 228, Tucson, Ariz. 85702

[21] Appl. No.: 648,708

[22] Filed: May 16, 1996

[51] Int. Cl.[6] ..... E05B 9/08

[52] U.S. Cl. ..... 70/370; 70/451

[58] Field of Search ..... 70/370, 450, 451, 70/452, 417

[56] References Cited

U.S. PATENT DOCUMENTS

| | | | |
|---|---|---|---|
| 2,940,293 | 6/1960 | Schlage | 70/451 |
| 3,713,683 | 1/1973 | Neary | 70/451 |
| 4,586,354 | 5/1986 | Smith | 70/370 |
| 4,765,165 | 8/1988 | O'Gara | 70/451 |
| 4,841,754 | 6/1989 | Jones | 70/452 |
| 5,216,910 | 6/1993 | Lin | 70/370 |
| 5,477,711 | 12/1995 | Oliveri | 70/370 |
| 5,551,268 | 9/1996 | Carnes | 70/370 |

FOREIGN PATENT DOCUMENTS

| | | | |
|---|---|---|---|
| 2360727 | 4/1978 | France | 70/451 |

*Primary Examiner*—Flemming Saether

[57] ABSTRACT

A guard plate for use with a vehicle's lock in which a circular combination of plates are strengthened by a peripheral flange which contains a second plate bonded to the first. The first plate uses a shoulder portion and ridges to creates added durability while the second plate includes a plateau to provide further strength. A snap member is used to secure the entire assembly next to the skin of the vehicle and the snap member is preferably larger than the guard plate so that added security is provided. A seal is used between the guard plate and the automobile's door's skin to weather-proof the assembly to the vehicle's door.

10 Claims, 6 Drawing Sheets

PROTECTIVE PLATE FOR AN AUTOMOBILE LOCKING MECHANISM

BACKGROUND OF THE INVENTION

This invention relates generally to automobiles and more particularly to protective door plates for automobiles.

Theft of automobiles is on the rise and the easiest place for a thief to gain access to a locking mechanism is through the lock cylinder. Typically an automobile's door or trunk has an opening which is used to contain the activator mechanism/lock cylinder to the lock mechanism inside the door or trunk. The activator mechanism, by necessity, requires a hole in the door or trunk.

To gain access to the internal locking mechanism, a thief often uses a pry bar such as a screw-driver which is inserted through the door's hole and the interior locking mechanism is accessed. Little noise is generated and door damage is minimal.

Recognition of this weakness in the security of an automobile has been around for many years; numerous devices have been developed which attempt to cure this deficiency.

One such device is described in U.S. Pat. No. 4,160,368, entitled "Automobile Trunk Lock Guard" issued to Solow on Jul. 10, 1979. This device provides a security plate which surrounds the lock cylinder. The plate is secured to the vehicle through the use of metal screws.

The use of metal screws requires added complexity in the installation process and also is not aesthetically pleasing. Additionally, the apparatus is unsuitable for a handle situation since the added plate's thickness disrupts the dimensional requirements for the handle to reach the interior locking mechanism.

Another attempt to provide additional security is described in U.S. Pat. No. 4,530,223, entitled "Guard For Key Cylinder" issued to Oliver on Jul. 23, 1985. This apparatus is a metal plate which bolts around the outside surface to protect the key cylinder. Again, the use of bolts are required and the plate is inoperative with a factory built handle.

In both of these situations, strength for the security plate is accomplished by expanding the thickness of the generally flat plate. This additional thickness prevents a thief from buckling or deforming the security plate; but, the added thickness also requires the use of a replacement handle as the factory installed handle is no longer able to reach the door's locking mechanism properly.

Recognizing that the less disruptive a device is to the existing automobile, the more likely the device is to be used, U.S. Pat. No. 4,619,123, entitled "Guard Plate and Method for Automobile Door Handle" issued to Hill on Oct. 28, 1986, and U.S. Pat. No. 5,176,016, entitled "Automobile Handle Guard Plate", issued to Hill on Jan. 5, 1993, were developed.

The Hill apparatus utilize the existing door handle and places a security plate between the handle and the automobile door. No drilling or exterior screws were needed and all of the existing parts on the automobile still interact with each other.

In certain situations though, the Hill security plate, being substantially a flat metal plate, can be bent or deformed by an aggressive thief and thereby permit access to the interior locking mechanism.

It is clear that there is a need for additional security at the activator mechanism.

SUMMARY OF THE INVENTION

The present invention creates a guard plate for use with a vehicle's lock or cylinder. The lock contemplated for use with this guard plate is generally circular in cross-section and extends through a vehicle's door such that a portion of the lock is accessible from exterior the door and an interior portion of the lock is connected with a locking clip mechanism used to secure the door to the door frame.

Those of ordinary skill in the art readily recognize various other locks which are usable with this invention.

The guard plate itself is a circular combination of plates in which the first plate is strengthened by a peripheral flange which contains a second plate bonded to the first.

When installed, preferably the flange on the first plate is directed toward the skin of the door and as such the first plate partially conceals the second plate. The flange, by encircling the first plate and reinforcing the safest metal lock hole, provides exceptional strength so as to prevent or dissuade thieves from being able to bend the guard plate to gain access to the door's interior locking mechanism.

To provide further strength, in the preferred embodiment, the first plate uses a shoulder portion and ridges to create added durability while the second plate includes a plateau to provide further strength. This contouring of the plates, and their interlocking aspect, create a highly rigid combination which is meant to dissuade the thief's efforts.

The guard plate is sandwiched between the outer portion of the lock and the skin of the vehicle. Pressure is provided by a 3 sided snap member which is used to secure the entire assembly next to the skin of the vehicle. Lock is still venerable from the open side remaining and easily identified by the thief.

In this manner, the present invention provides for a reinforced guard plate.

Further security is provided by the snap member itself which is preferably larger than the guard plate. Should a thief be able to force past the guard plate on the outer of side of the door, the enlarged snap member frustrates the thief's attempts to proceed further. This establishes an added level of security.

In one embodiment of the invention, two members form the snap member and are interlocked to totally enclose the interior portion of the lock mechanism. This provides another barrier against a thief's pry bar by closing weak end of 3 sided snap member and keeping ends from spreading apart and failing.

To keep moisture, dust, and other foreign matter from entering the automobile door, a seal is used between the guard plate and the automobile's door's skin.

The seal is chosen to have a thickness which is sufficient to maintain the guard plate's flange from contacting the skin of the automobile's door. This provides a proper seal and keeps the metal guard plate from improperly rubbing against the door's skin.

The invention together with various embodiments thereof will be more fully explained by the accompanying drawings and the following descriptions.

DRAWINGS IN BRIEF

DRAWINGS IN DETAIL

Figure 1B:
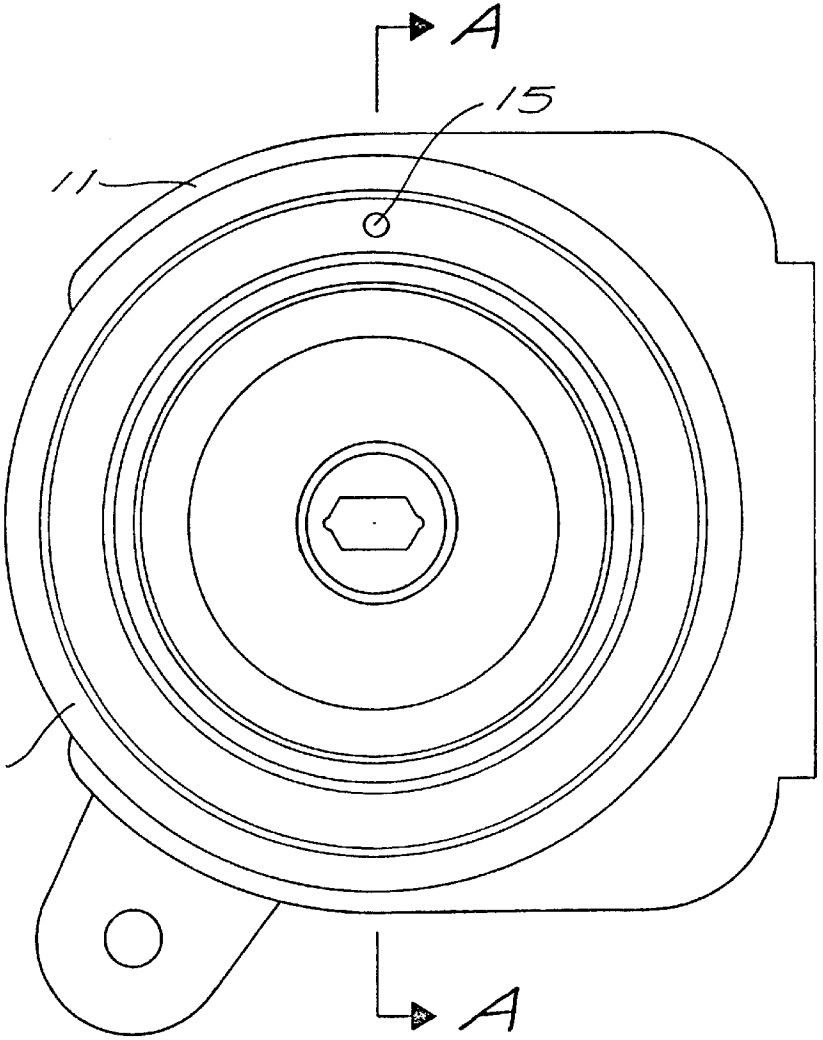
FIGS. 1A and 1B are side and frontal views of the preferred embodiment in an assembled state with the automobile lock cylinder.
Figure 1A:
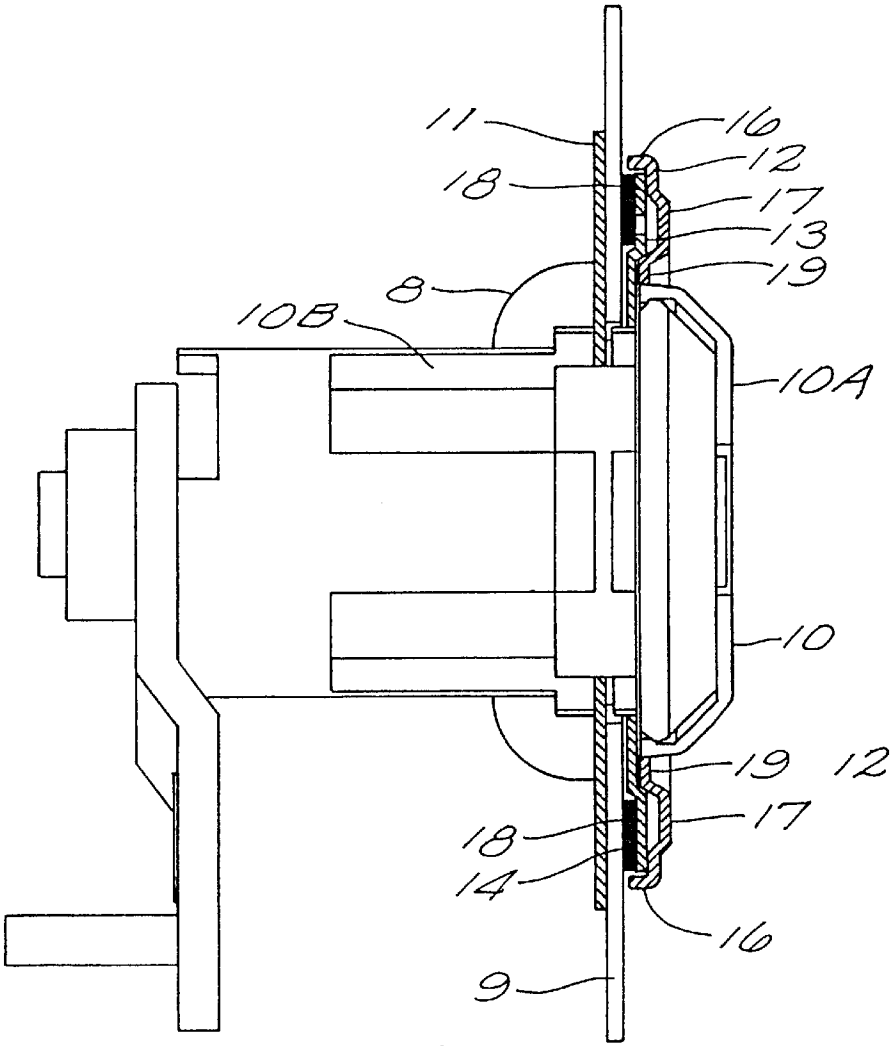

FIGS. 1A and 1B are side and frontal views of the preferred embodiment in an assembled state with the automobile lock mechanism.

The guard plate consists of a base plate 13 which is bonded to a cap cover 12. Cap cover 12 includes a flange 16 which encircles the cap cover 12 and is used to enclose base plate 13.

Base plate 13 is bonded to cap cover 12 using a variety of methods well known to those in the art including: adhesives, welding, brazing, and others.

Cap cover 12 includes a shoulder portion 19 and a raised ridge 17. Ridge 17 provides further mechanical strength to the assemblage.

Base plate 13 includes a plateau 18 which is configured to mate with shoulder 19. Plateau 18 provides further mechanical strength and with the mating with cap cover 12, provides for a secure arrangement once the two are bonded to each other.

Seal or gasket 14 is placed between the door plate and skin 9 of the automobile. Gasket 14 provides a weather proofing so that moisture is not permitted into the interior of the automobile's door.

Weep hole 15 is provided to allow moisture which may be trapped between cap cover 12 and base plate 13 to escape. This diminishes the potential for the development of rust and a weakening of the door plate.

In applying the guard plate, the lockset cylinder 10 is inserted through the hole in the door protector such that an outer portion 10A of the lockset hardware 10 presses against the guard plate and presses seal 14 against the skin 9 of the door.

An interior portion 10B of lockset hardware 10 passes through the guard plate and is secured by retainer clip 11 which serves as a snap bracket to maintain a secure relationship between all of the parts.

The retainer clip or snap bracket 11 in the preferred embodiment is larger than the guard plate composed of base plate 13 and cap cover 12. This provides for additional security from theft.

To assist in the application of retainer clip 11, finger tab 8 is provided. Finger tab 8 is positioned substantially at right angles to retainer clip 11 and as such provides for easy application and securement of the guard plate assembly without the requirement of tools.

Figure 2B:
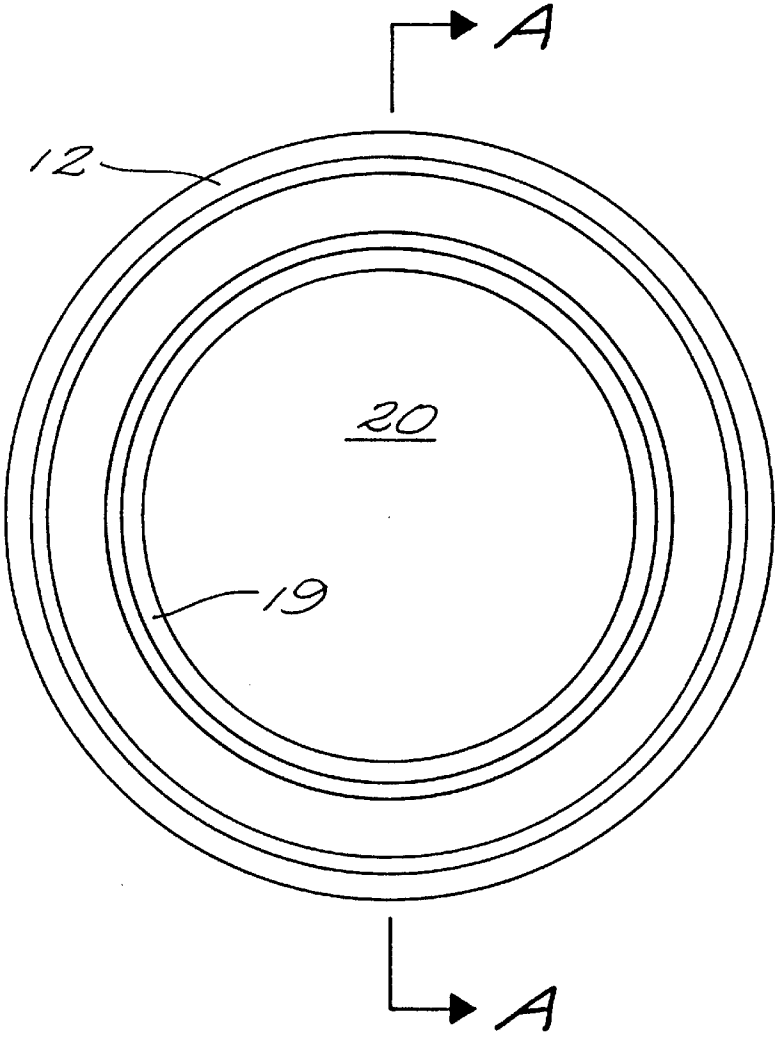
FIGS. 2A and 2B are side and frontal views of the outer member of the preferred door plate.
Figure 2A:
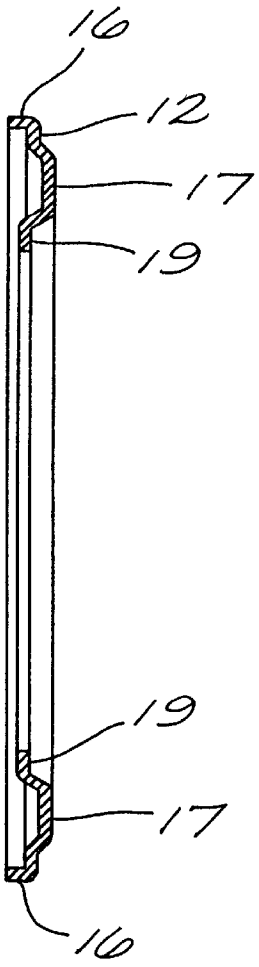

FIGS. 2A and 2B are side and frontal views of the outer member of the preferred door plate.

Cap cover 12 includes a flange 16 which encircles the cap cover 12 and is used to enclose base plate 13. Further, cap cover 12 includes a shoulder portion 19 and a raised ridge 17. Ridge 17 provides further mechanical strength to the assemblage.

Cap cover 12 is substantially circular in shape which eliminates exterior corners or angles which may permit the thief's pry-bar from gaining easy access.

Interior hole 20 has shoulder 19 surrounding it. Shoulder 19, in combination with ridge 17 provide barriers and mechanical strength so that the locking mechanism, not shown, cannot be easily driven through the guard plate. This combination also gives additional mechanical support to cap cover 12 so that it is more resistive to bending.

Figure 3B:
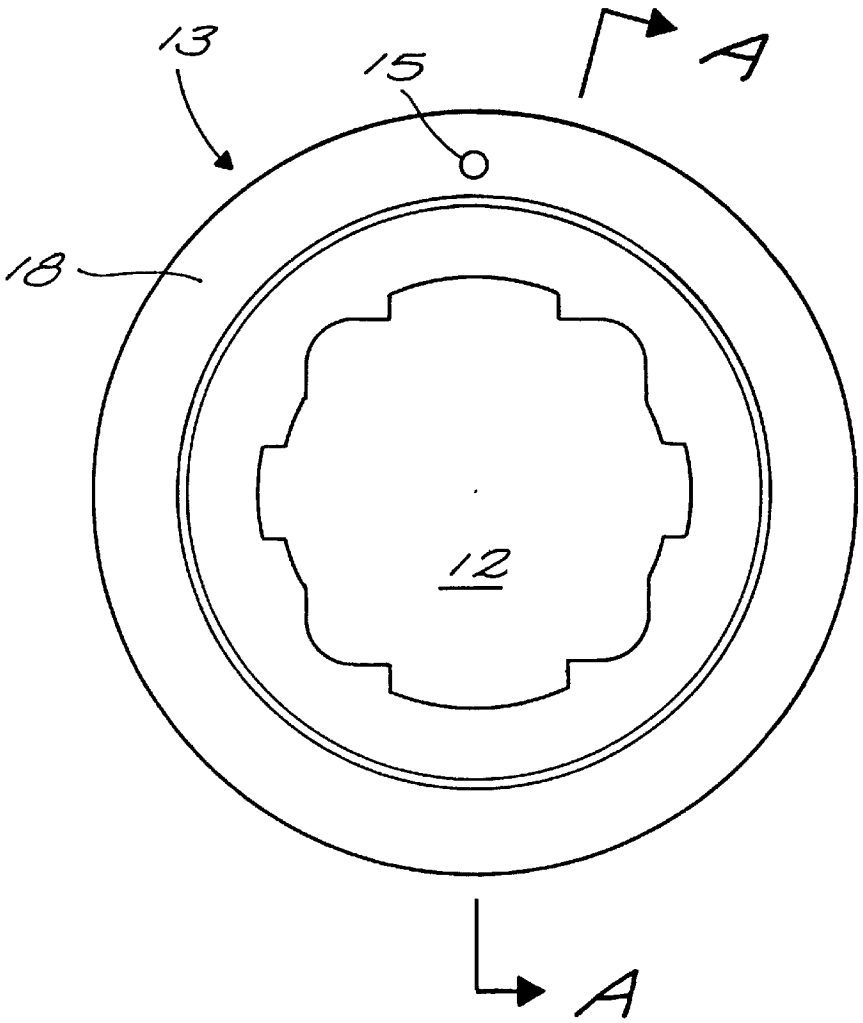
FIGS. 3A and 3B are side and frontal views of the inner member of the preferred door plate.
Figure 3A:
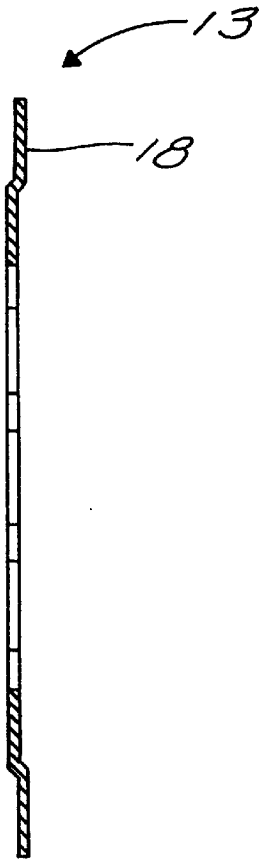

FIGS. 3A and 3B are side and frontal views of the inner member of the preferred door plate.

Base plate 13 includes a plateau 18 which is configured to mate with shoulder 17 of the cap cover (not shown in this illustration). Plateau 18 provides further mechanical strength and with the mating with cap cover, provides for a secure arrangement once the two are bonded to each other.

Base plate 13 is bonded to cap cover 12 using a variety of methods well known to those in the art including: adhesives, welding, brazing, and others.

Weep hole 15 is provided to allow moisture which may be trapped between cap cover 12 and base plate 13 to escape. This diminishes the potential for the development of rust and a weakening of the door plate.

Opening 30 is shaped to mate with the lock set. In the preferred embodiment, opening 30 is configured such that the lock set is insertable through opening 30 in a unique manner. That is, there is always an "up" and a "down" on the door plate.

The irregular configuration of opening 30 prevents the guard plate from rotating around the lock set. Since the lock plate cannot move, this assures that movement of the plate will not damage either the seal member or scratch the vehicle's door.

Figure 4B:
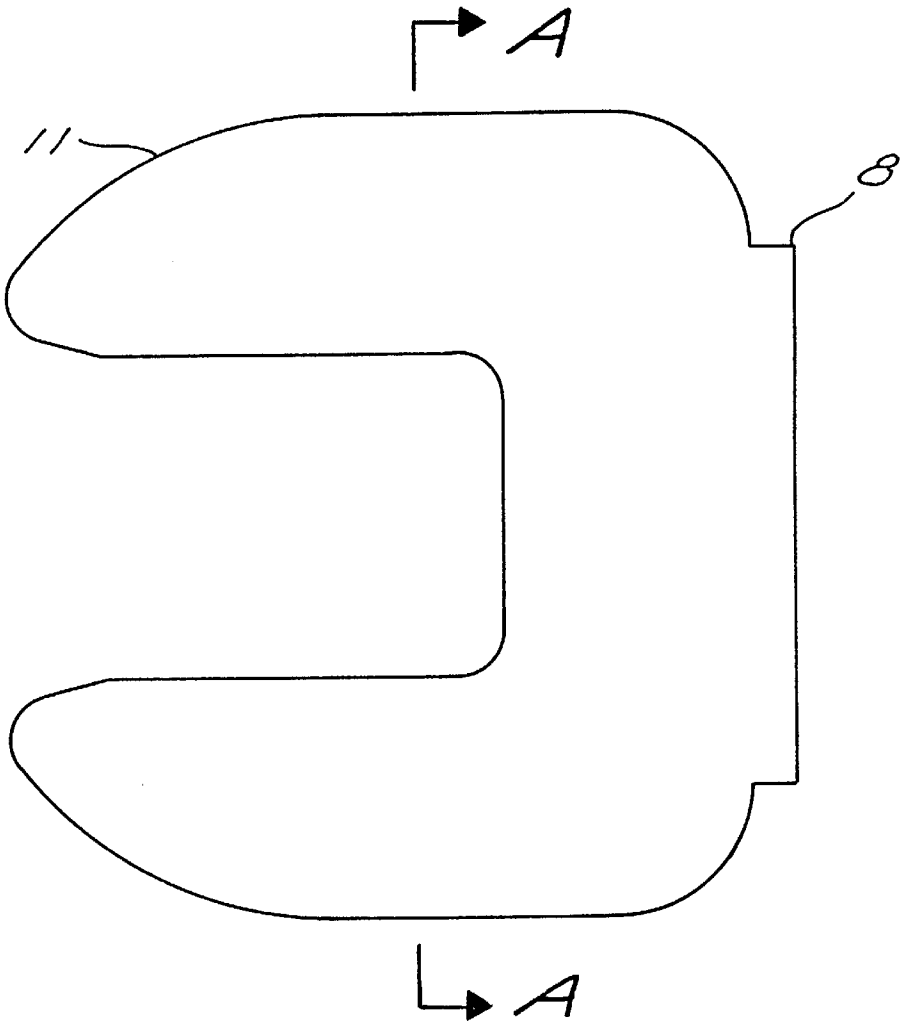
FIGS. 4A and 4B are side and frontal views of the snap member used to secure the lock mechanism to the automobile door.
Figure 4A:
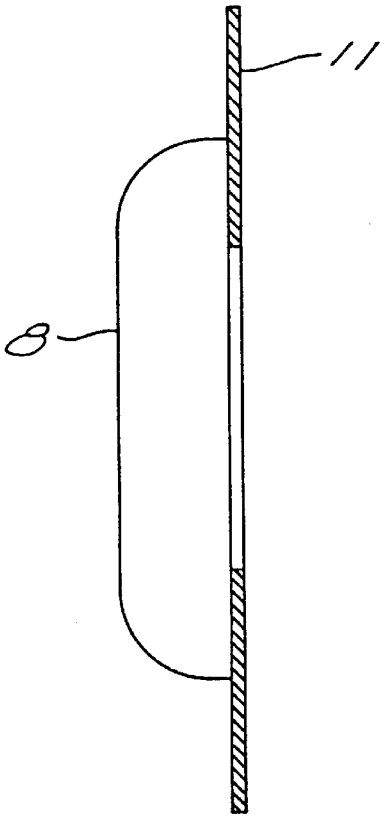

FIGS. 4A and 4B are side and frontal views of the snap member used to secure the lock mechanism to the automobile door.

To reiterate, In applying the guard plate, the lockset mechanism is inserted through the hole in the door protector such that an outer portion of the lockset hardware presses against the guard plate and presses the seal against the skin of the door. In this context, an interior portion of the lockset hardware passes through the guard plate and is secured by retainer clip 11.

Retainer clip 11 serves as a snap bracket to maintain a secure relationship between all of the parts. The retainer clip or snap bracket 11 in the preferred embodiment is larger than the guard plate composed of base plate 13 and cap cover 12. This provides for additional security from theft.

To assist in the application of retainer clip 11, finger tab 8 is provided. Finger tab 8 is positioned substantially at right angles to retainer clip 11 (an hence the skin of the automobile door) and as such provides for easy application and securement of the guard plate assembly without the requirement of tools.

In one embodiment of snap member 11, snap member 11 is substantially circular, as illustrated by dotted lines 40.

Figure 5:
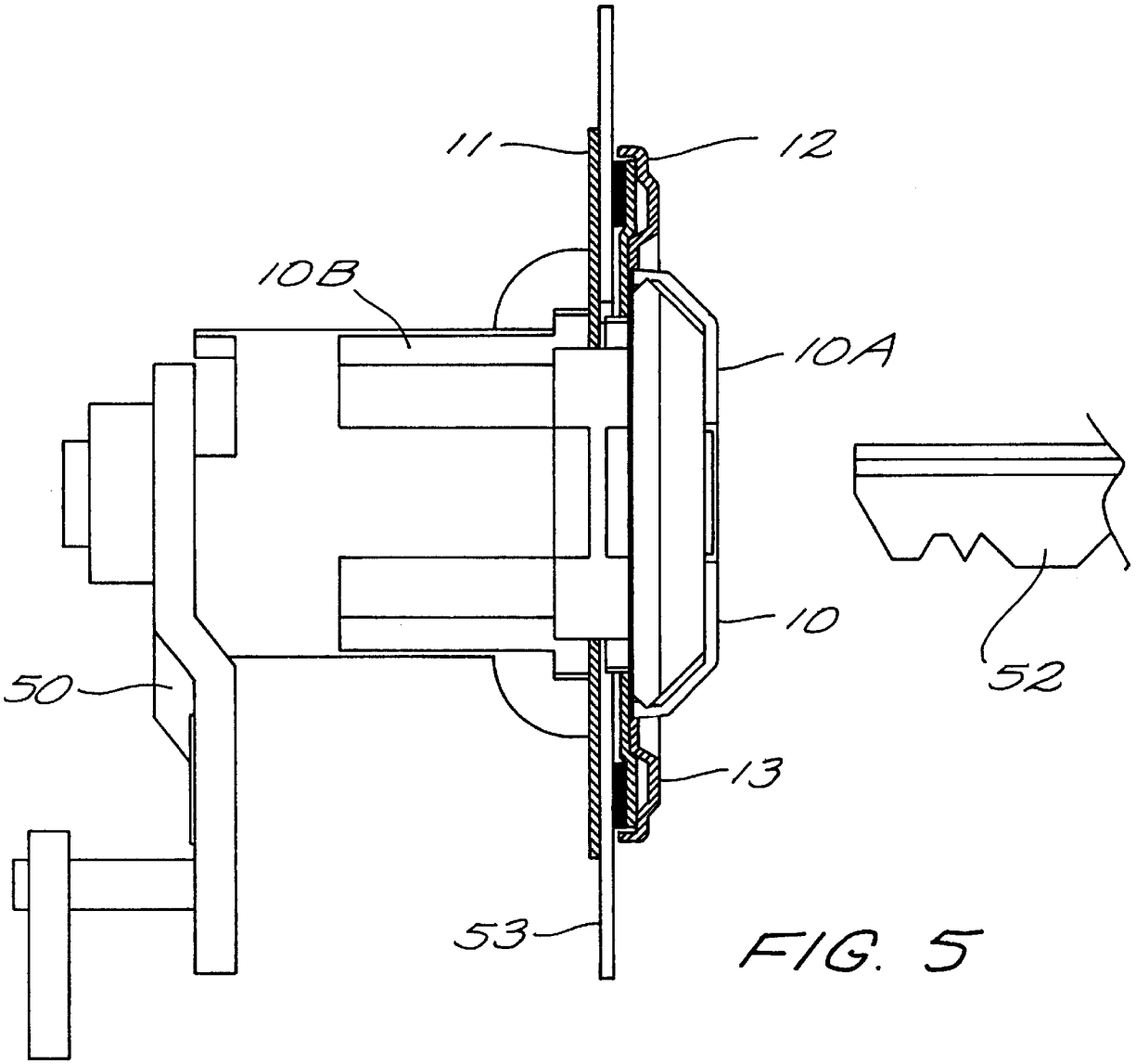
FIG. 5 is a side view of the preferred embodiment illustrating the interior locking mechanism.

FIG. 5 is a side view of the preferred embodiment illustrating the interior locking mechanism.

Lock 10 is inserted through the cap cover 12 and the base plate 13 such that an interior portion 10B extends into the door. Snap ring 11 secures the entire assembly to the vehicle's door 53.

Lock 10 accepts key 52 and manipulates arm 50 such that the lock mechanism, connected to rod 51, is altered between a locked and an unlocked state.

Figure 6B:
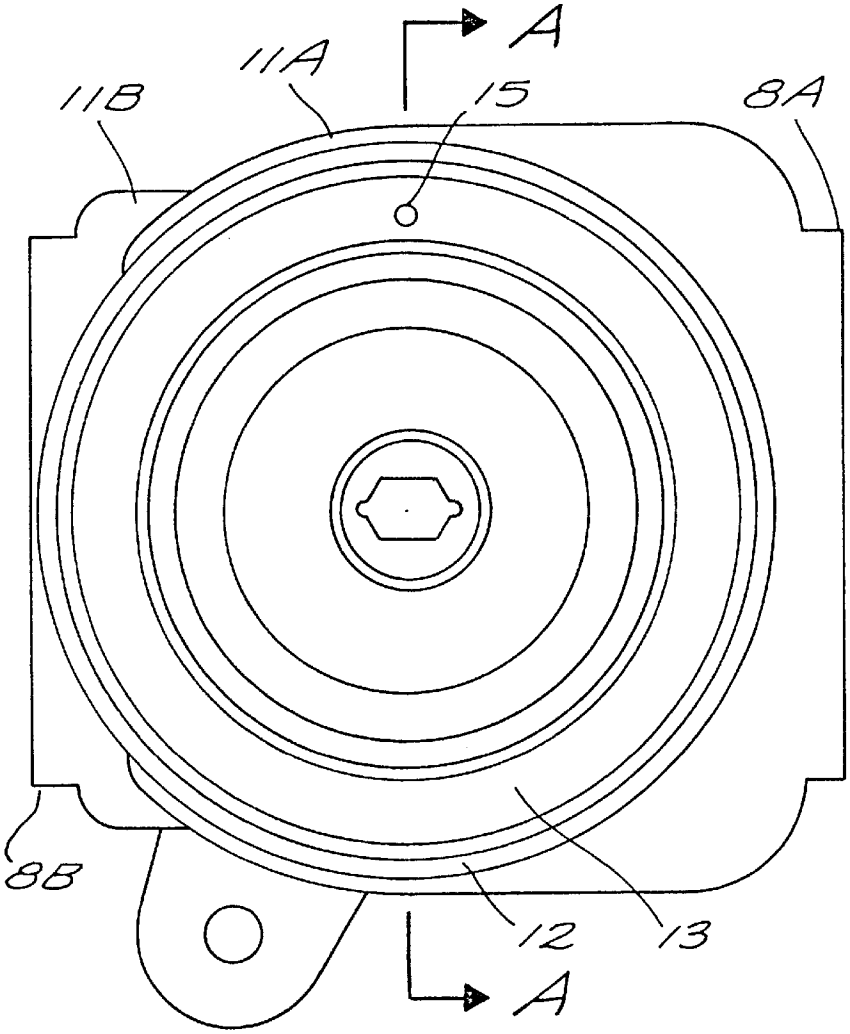
FIG. 6 illustrates an alterative embodiment of the snap member used to secure the assembly to the vehicle's door.
Figure 6A:
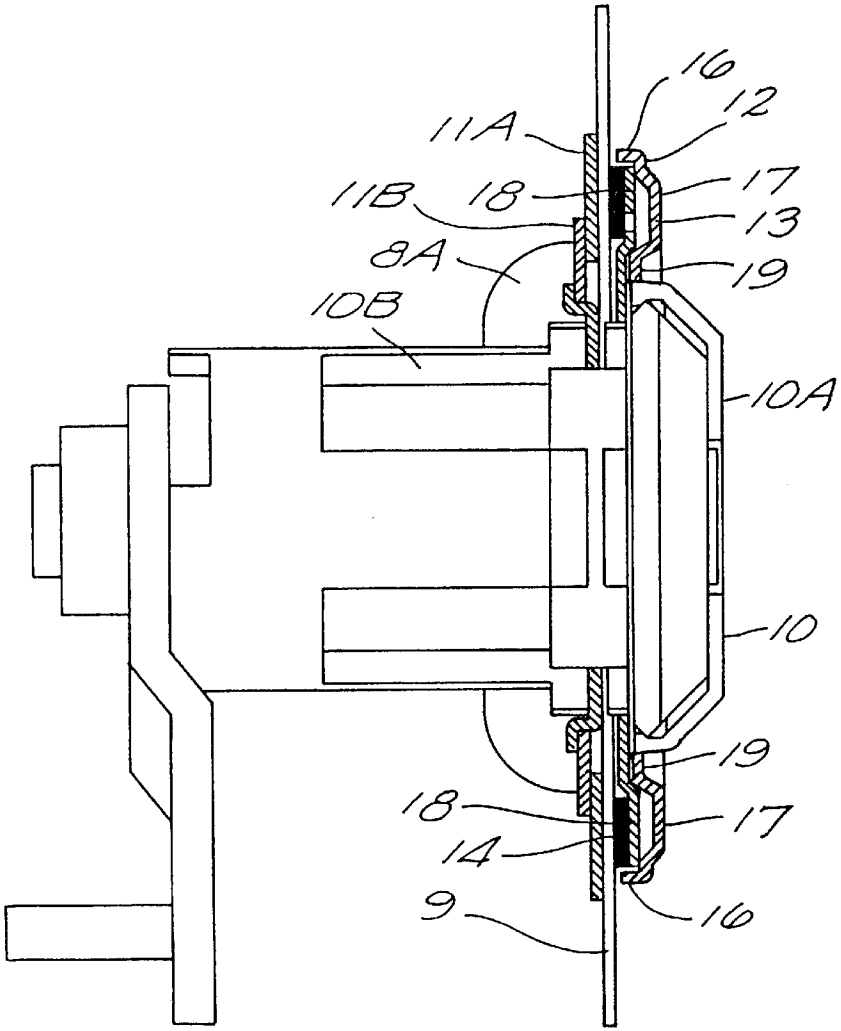

FIG. 6 illustrates an alterative embodiment of the snap member used to secure the assembly to the vehicle's door.

In this embodiment, two complimentary flat members 11A and 11B are adapted to totally encircle the locking cylinder (not shown). Each complimentary flat member, 11A and 11B contain a tab, 8A and 8B respectively, to assist in the flat member's assembly to the system.

In this manner, the locking cylinder portion which extends through said automobile door, is totally encircled by flat members 11A and 11B to provide even greater security from a thief's pry bar.

It is clear from the foregoing that the present invention creates a highly improved protective mechanism for an automobile door's locking mechanism.

What is claimed is:

1. An automobile door lock comprising:

a) a locking cylinder extending through a skin of an automobile door;

b) a guard plate interposed between an outer portion of said locking cylinder and skin of an automobile door and having, 1) a first member being substantially circular in shape and having, A) a flange encircling an entirety of an outer periphery thereof, B) a substantially circular opening, and, C) a shoulder portion positioned around a periphery of said circular opening, and, 2) a second member, bonded to said first member within said flange and being substantially circular in shape, said second member having an opening accessible through said substantially circular opening of said first member, the opening of said second member adapted to connect with the locking cylinder in a unique orientation; and, c) a snap bracket connected to said locking cylinder on an interior portion of said automobile door, said snap bracket being substantially circular and having a diameter larger than said first member.

2. The automobile door lock according to claim 1 wherein said snap bracket includes a finger tab positioned substantially at right angles to the interior portion of said automobile door.

3. The automobile door lock according to claim 2 wherein said snap bracket includes two complimentary flat members adapted to totally encircle said locking cylinder extending through said automobile door.

4. The automobile door lock according to claim 1 wherein said second member further includes a plateau encircling said opening therein.

5. The automobile door lock according to claim 4 wherein the plateau of said second member is adapted to nest with the shoulder portion of said first member when said first member and said second member are bonded together.

6. The automobile door lock guard according to claim 1 wherein said first member includes a re-enforcing ridge encircling said circular opening in said first member.

7. An automobile door lock comprising:

a) a locking cylinder extending through a skin of an automobile door;

b) a reinforced guard plate interposed between an outer portion of said locking cylinder and the skin of the automobile door, said reinforced guard plate having, 1a first member being substantially circular in shape and having, A) a flange encircling an entirety of an outer periphery thereof, B) a substantially circular opening, and, C) a shoulder portion positioned around a periphery of said circular opening, and, 2a second member, bonded to said first member within said flange and being substantially circular in shape, said second member having an opening accessible through said substantially circular opening of said first member, the opening of said second member adapted to connect with the locking cylinder; and, c) a snap bracket connected to said locking cylinder on an interior portion of said automobile door.

8. The automobile door lock according to claim 7 wherein said snap is substantially circular and having a diameter larger than said reinforced guard plate.

9. The automobile door lock according to claim 8 wherein said snap is composed of two complimentary flat members adapted to totally encircle a portion said locking cylinder extending through said automobile door.

10. The automobile door lock according to claim 7 further including a substantially circular seal member adapted to fit between the flange of said first member and the plateau of the second member.

* * * * *